US008542850B2

(12) United States Patent
Wang et al.

(10) Patent No.: US 8,542,850 B2
(45) Date of Patent: Sep. 24, 2013

(54) MINIATURE MICROPHONE ASSEMBLY WITH HYDROPHOBIC SURFACE COATING

(75) Inventors: Christian Wang, Copenhagen N (DK); Jörg Rehder, Virum (DK); Leif Steen Johansen, Brønshøj (DK); Peter Ulrik Scheel, Gentofte (DK)

(73) Assignee: Epcos Pte Ltd, Singapore (SG)

( * ) Notice: Subject to any disclaimer, the term of this patent is extended or adjusted under 35 U.S.C. 154(b) by 685 days.

(21) Appl. No.: 12/231,398

(22) Filed: Sep. 2, 2008

(65) Prior Publication Data

US 2009/0067659 A1 Mar. 12, 2009

Related U.S. Application Data

(60) Provisional application No. 61/130,524, filed on May 30, 2008, provisional application No. 60/993,466, filed on Sep. 12, 2007.

(51) Int. Cl.
*H04R 25/00* (2006.01)

(52) U.S. Cl.
USPC ..... 381/175; 381/174; 381/355; 381/361

(58) Field of Classification Search
USPC ..... 381/355, 361, 369, 174, 175
See application file for complete search history.

(56) References Cited

U.S. PATENT DOCUMENTS

| | | | | |
|---|---|---|---|---|
| 5,532,608 | A * | 7/1996 | Behfar-Rad et al. | 324/754.07 |
| 5,889,871 | A | 3/1999 | Downs, Jr. | |
| 6,178,249 | B1 | 1/2001 | Hietanen et al. | |
| 6,522,762 | B1 | 2/2003 | Mullenborn | |
| 6,859,542 | B2 * | 2/2005 | Johannsen et al. | 381/174 |
| 7,142,682 | B2 | 11/2006 | Müllenborn et al. | 381/322 |
| 7,447,323 | B2 | 11/2008 | Mullenborn et al. | 381/174 |
| 7,491,286 | B2 * | 2/2009 | Kagan et al. | 156/230 |
| RE40,781 | E | 6/2009 | Johannsen et al. | 381/174 |
| 7,545,945 | B2 * | 6/2009 | Miles | 381/174 |
| 7,548,626 | B2 | 6/2009 | Stenberg et al. | 381/113 |

(Continued)

FOREIGN PATENT DOCUMENTS

| | | |
|---|---|---|
| CN | 1511429 | 7/2004 |
| CN | 1838833 | 9/2006 |

(Continued)

OTHER PUBLICATIONS

Fabianowski, Wojciech, "Coupling Monolayers for Protection of Microelectronic Circuits", 1995 by John Wiley & Sons Ltd., vol. 5, pp. 1, 200-213.*

(Continued)

*Primary Examiner* — Davetta W Goins
*Assistant Examiner* — Amir Etesam
(74) *Attorney, Agent, or Firm* — Nixon Peabody LLP

(57) ABSTRACT

A miniature microphone assembly comprises a capacitive-microphone transducer, a microphone carrier, and an integrated circuit die. The capacitive-microphone transducer includes a microphone-electrical contact or terminal. The microphone carrier comprises a carrier electrical contact or terminal formed on a first surface of the microphone carrier. An integrated circuit die includes a die electrical terminal operatively coupled to signal amplification or signal conditioning circuitry of the integrated circuit die. The first surface of the microphone carrier comprises a hydrophobic layer or coating. The side surfaces of the integrated circuit die and/or the capacitive-microphone transducer may also include the hydrophobic layer or coating.

23 Claims, 2 Drawing Sheets

(56) References Cited

U.S. PATENT DOCUMENTS

| | | | | |
|---|---|---|---|---|
| 7,567,828 | B1 * | 7/2009 | Burson | 455/575.2 |
| 7,622,813 | B2 * | 11/2009 | Brewer | 257/797 |
| 7,630,504 | B2 | 12/2009 | Poulsen | 381/111 |
| 7,634,096 | B2 | 12/2009 | Fallesen | 381/113 |
| 7,792,315 | B2 | 9/2010 | Müllenborn et al. | 381/175 |
| RE42,346 | E * | 5/2011 | Rombach et al. | 381/174 |
| RE42,347 | E | 5/2011 | Rombach et al. | 381/174 |
| 8,036,401 | B2 | 10/2011 | Poulsen et al. | 381/113 |
| 8,094,846 | B2 | 1/2012 | Hovesten et al. | 381/312 |
| 8,097,483 | B2 | 1/2012 | Van Schaijk et al. | 438/52 |
| 8,103,025 | B2 | 1/2012 | Mullenborn et al. | 381/174 |
| 8,143,967 | B2 | 3/2012 | Schmidhammer | 333/17.3 |
| 8,170,249 | B2 | 5/2012 | Halteren | 381/322 |
| 8,259,963 | B2 | 9/2012 | Stenberg et al. | 381/113 |
| 8,284,966 | B2 | 10/2012 | Wilk et al. | 381/189 |
| 8,295,528 | B2 | 10/2012 | Rombach et al. | 381/369 |
| 8,305,069 | B2 | 11/2012 | Bouwman et al. | 323/313 |
| 8,305,136 | B2 | 11/2012 | Schmidhammer | 327/554 |
| 8,330,667 | B2 | 12/2012 | Boyle | 343/750 |
| 2002/0102004 | A1 * | 8/2002 | Minervini | 381/175 |
| 2002/0181725 | A1 | 12/2002 | Johannsen et al. | 381/174 |
| 2004/0179709 | A1 | 9/2004 | Niederdraenk et al. | |
| 2006/0237806 | A1 | 10/2006 | Martin et al. | |
| 2008/0298621 | A1 * | 12/2008 | Theuss et al. | 381/360 |
| 2009/0214061 | A1 | 8/2009 | Johansen et al. | 381/174 |
| 2010/0176895 | A1 | 7/2010 | Schmidhammer | 333/32 |
| 2010/0176899 | A1 | 7/2010 | Schäufele et al. | 333/187 |
| 2010/0237962 | A1 | 9/2010 | Schmidhammer | 333/26 |
| 2011/0006381 | A1 | 1/2011 | Feiertag et al. | 257/416 |
| 2011/0110536 | A1 | 5/2011 | Hovesten et al. | 381/111 |
| 2011/0114355 | A1 | 5/2011 | Bauer et al. | 174/50.5 |
| 2011/0133315 | A1 | 6/2011 | Pahl et al. | 257/659 |
| 2011/0170714 | A1 | 7/2011 | Hanzlik et al. | 381/111 |
| 2011/0180885 | A1 | 7/2011 | Pahl et al. | 257/415 |
| 2011/0230068 | A1 | 9/2011 | Pahl | 439/65 |
| 2011/0233690 | A1 | 9/2011 | Feiertag et al. | 257/414 |
| 2011/0298064 | A1 | 12/2011 | Pahl et al. | 257/415 |
| 2012/0093346 | A1 | 4/2012 | Feiertag et al. | 381/174 |
| 2012/0224726 | A1 | 9/2012 | Pahl | 381/174 |
| 2012/0225259 | A1 | 9/2012 | Mortensen et al. | 428/195.1 |
| 2012/0235735 | A1 | 9/2012 | Spits et al. | 330/126 |
| 2012/0275634 | A1 | 11/2012 | Leidl et al. | 381/369 |
| 2012/0299131 | A1 | 11/2012 | Henn | 257/416 |
| 2012/0326249 | A1 | 12/2012 | Rombach | 257/416 |

FOREIGN PATENT DOCUMENTS

| | | | |
|---|---|---|---|
| CN | 1849016 | | 10/2006 |
| EP | 1432281 | A2 | 6/2004 |
| EP | 1703764 | | 9/2006 |
| EP | 1821570 | A1 | 8/2007 |
| WO | 02/098166 | A1 | 12/2002 |
| WO | 2006/096005 | A1 | 9/2006 |
| WO | 2007/112743 | A1 | 10/2007 |
| WO | 2011/092137 | | 8/2011 |
| WO | 2011/107159 | | 9/2011 |
| WO | 2011/144570 | | 11/2011 |

OTHER PUBLICATIONS

Fabianowski, Wojciech, "Coupling Monolayers for Protection of Microelectronic Circuits"' 1995 by John Wiley & Sons Ltd., vol. 5, pp. 1, 200-213.*

European Search Report corresponding to European Patent Application No. 08163570.8, European Patent Office; dated Mar. 8, 2011, (7 pages).

Sarvar F. et al.; "Application of Adhesives in MEMS and MOEMS Assembly: A Review"; Polymers and Adhesives in Microelectronics and Photonics, 2002. Polytronic 2002. 2nd International IEEE Conference on Jun. 23-26, 2002, XP010594226, ISBN 0-7803-7567-X. (7 pages).

Baker H. R., et al.; "Surface Electrical Leakage on Insulators and Coatings in the Presence of Moisture Condensation"; IEEE Transactions on Electrical Insulation, vol. EI-11, No. 3.; XP_11162181A; Dated Sep. 3, 1976; (5 pages).

English translation of Chinese office action mailed Jul. 23, 2012 which issued in corresponding Chinese Patent Application No. 200810149114.7 (8 pages).

* cited by examiner

MINIATURE MICROPHONE ASSEMBLY WITH HYDROPHOBIC SURFACE COATING

RELATED APPLICATIONS

This application claims priority to U.S. Provisional Application No. 61/130,524, filed May 30, 2008, and U.S. Provisional Application No. 60/993,466, filed Sep. 12, 2008, which are hereby incorporated by reference in their entirety.

FIELD OF THE INVENTION

The present invention relates to a miniature microphone assembly that comprises a microphone carrier with hydrophobic surface coating and/or an integrated circuit die with hydrophobic surface coating to improve electrical insulating properties of one or both of these components.

BACKGROUND OF THE INVENTION

Miniature microphone assemblies regularly comprise a capacitive microphone transducer electrically coupled to an integrated circuit die that comprises suitable signal amplification and conditioning circuitry. The signal amplification and conditioning circuitry may comprise a low-noise preamplifier or buffer, frequency selective filters, a DC bias voltage generator etc., adapted to amplify/buffer, filter or perform other forms of signal conditioning or generation. The integrated circuit die may comprise one or more die electrical terminal(s), for example a signal input signal terminal or a DC bias voltage terminal, electrically coupled to the capacitive microphone transducer. It is highly desirable and advantageous to provide extremely high input impedance at one or several of these die electrical terminal(s)—for example to optimize noise properties or ensure a stable DC bias voltage for the miniature microphone assembly. An extremely high input impedance at the signal input terminal ensures that loading of the capacitive microphone transducer, often having a generator impedance that corresponds to a capacitance of about 1 pF, is minimized so as to prevent attenuation of weak and fragile audio signals generated by capacitive microphone transducer in response to impinging sound.

Accordingly, this signal input terminal of the integrated circuit die is customary designed to present an input impedance higher than 100 GΩ, such as higher than 1 TΩ ($10^{12}$Ω) or even several TΩ for the capacitive microphone transducer. The input impedance is often determined by an independent bias network on the integrated circuit die, for example a pair of reverse biased diodes, in combination with the previously-mentioned amplification and conditioning circuitry operatively coupled to the signal input terminal.

However, experimental work conducted by the present inventors has demonstrated the difficulty in maintaining the desired extremely high input impedance at the die electrical terminal(s) under realistic operating conditions such as, for example, environmental conditions that include exposure to moisture, cyclic heat and/or exposure to polluting agents. Under such adverse conditions, the input impedance at terminals of the integrated circuit die can be significantly degraded by a formation or absorption of a thin electrically conducting layer of moisture or water on those surfaces of the microphone carrier and/or the integrated circuit die that surround or abut the carrier electrical contact and the die electrical terminal. The formation or absorption of the thin electrically conducting layer of moisture may be caused by condensation or constant high humidity. The effect is a formation of a parallel resistive path, or current leakage path, between the die electrical terminal(s) or the carrier electrical contact and another electrical terminal of the carrier and/or integrated circuit die. The other electrical terminal may be a ground terminal or a DC voltage supply terminal. This causes a detrimental, and potentially very large, reduction of the input impedance at the die electrical terminal(s). For a signal input terminal on the integrated circuit die, the input impedance may drop from the desired range above 100 GΩ down to a range below a few GΩ, or even down to a MΩ range.

According to the present invention, the problems associated with the formation of undesired current leakage path(s) is solved by a deposition of a hydrophobic coating or layer onto the surface of the microphone carrier that holds or supports one or more high impedance carrier electrical terminals. In addition, a hydrophobic coating or layer may advantageously be deposited on surface(s) of integrated circuit die that holds high impedance electrical terminals or pads. Hydrophobic coatings or layers have been for a multitude of purposes, some of which may be seen in WO2007/112743, US2006/237806, EP1821570, WO2006/096005 and "Application of adhesives in MEMS and MOEMS assembly: a review"; Polymers and Adhesives in Microelectronics and Photonics, 2002. POLYTRONIC 2002. 2$^{nd}$ International IEEE Conference on Jun. 23-26, 2002, 20020623; 20020623-20020626 Piscataway, N.J., USA, IEEE, XP010594226.

Miniature microphone assemblies in accordance with the present invention are well-suited for a diverse range of applications including portable communication devices such as cellular or mobile phones, hearing aids, PDAs, game consoles, portable computers etc.

SUMMARY OF THE INVENTION

According to a first aspect of the invention, there is provided a miniature microphone assembly comprising a capacitive microphone transducer, a microphone carrier, and an integrated circuit die. The capacitive microphone transducer comprises a microphone electrical contact or terminal. The microphone carrier comprises a carrier electrical contact or terminal formed on a first surface thereof. The integrated circuit die comprises a die electrical terminal operatively coupled to signal amplification or signal conditioning circuitry of the integrated circuit die. The first surface of the microphone carrier comprises a hydrophobic coating or layer and/or a surface of the integrated circuit die comprises a hydrophobic coating or layer.

Naturally, a number of types of transducer may be used. Preferably, the capacitive microphone transducer comprises a condenser element or electret element such as a microelectromechanical (MEMS) condenser element.

The hydrophobic layer may be deposited on one or more surfaces of each of the components of the miniature microphone assembly, or solely on a single component such as the microphone carrier, by selection of appropriate manufacturing methodologies and steps.

According to a preferred embodiment of the invention, a plurality of MEMS based miniature microphone assembles, such as 1000 to 5000 assemblies, are assembled on a silicon wafer attached to a support tape. The silicon wafer is diced and the diced wafer, which still holds the MEMS microphone assemblies, is moved into a deposition chamber. A plasma treatment is applied to the diced wafer to rinse exposed surfaces of all MEMS miniature microphone assemblies. Thereafter, a suitable hydrophobic coating agent or material is applied to the diced wafer by gas phase deposition to perform a batch coating of exposed surfaces of all MEMS miniature microphone assemblies. It may be preferable to avoid the deposition of the hydrophobic coating agent on certain electrical terminals of the MEMS miniature microphone assemblies, for example externally accessible SMD compatible electrical terminals or contacts. This shielding may be provided by letting the support tape cover or shield those surface portions of the microphone carriers where the externally accessible SMD electrical contact pads are placed during the hydrophobic layer deposition step.

According to another embodiment of the invention, the MEMS based miniature microphone assembly is provided in a form where only the microphone carrier of each microphone assembly is coated with the hydrophobic layer. The microphone carrier may comprise a ceramics or silicon type of substrate. A diced or un-diced ceramic-tile microphone carrier, or diced or un-diced silicon microphone carrier, is moved into a deposition chamber. A plasma treatment may be applied to the diced or un-diced carrier tile or wafer to rinse exposed surfaces of all carriers in a batch process. Thereafter, a suitable hydrophobic coating agent or material may be applied to the un-diced or diced tiles or wafers by gas phase deposition to perform a batch coating of the exposed surfaces. The capacitive microphone transducer and the integrated circuit die are preferably subsequently soldered to the hydrophobically coated surface of the microphone carrier by, for example, a flip-chip assembly process or a wire-bonding process.

The capacitive microphone transducer may comprise a condenser element or electret element such as a microelectromechanical (MEMS) condenser element. The air gap height of the microphone transducer is preferably within a range between 15-50 μm for non-MEMS microphones such as traditional miniature electret condenser microphones (ECMs) for hearing instrument or telecom applications. These ECMs are based on an electret microphone transducer which includes an electrically pre-charged layer deposited on a diaphragm element or a back-plate element. The air gap height for MEMS based microphone transducers is preferably between 1 and 10 μm. For miniature microphone assemblies, a capacitance of the capacitive microphone transducer is preferably less than 20 pF, such as less than 10 pF, or less than 5 pF, such as less than 2 pF.

The capacitive microphone transducer may comprise a diaphragm member and an adjacently positioned back-plate member separated by a narrow air gap. The back-plate member is preferably a highly perforated structure having a plurality of acoustic holes or openings such as hundreds of thousands of acoustic holes. The diaphragm member may comprise a through-going opening or aperture operating as a DC vent or static pressure relief for air trapped in the back chamber below the diaphragm and back-plate members. The through-going diaphragm opening may have dimensions, for example a diameter, between 1 μm and 4 μm for miniature MEMS based capacitive microphone transducers. The through-going diaphragm opening may have dimensions, for example a diameter, between 10 μm and 50 μm for the previously-mentioned miniature ECMs with electret based capacitive microphone transducers.

The through-going opening in the diaphragm member allows molecules of the hydrophobic layer to travel through the diaphragm opening and the perforated back-plate structure. The hydrophobic layer can thereby be deposited on microphone carrier surfaces that otherwise would be difficult to access due to their placement underneath the capacitive microphone transducer in an assembled state of the microphone assembly. These surfaces may comprise sidewall and corner structures of a back chamber formed in the microphone carrier. The microphone carrier may comprise first and second carrier electrical contacts separated by a distance of less than 1000 μm, such as less than 500 μm, or less than 250 μm. The first and second carrier electrical contacts comprise a first contact electrically connected to the die electrical terminal and a second contact electrically connected to a ground line or DC voltage supply line. The small separation between carrier electrical contacts is often necessary for so-called Chip Scale Package (CSP) embodiments of the present miniature microphone assembly. In a CSP package, the capacitive microphone transducer and integrated circuit die are adjacently arranged and positioned above the first surface of the microphone carrier in a "face-down" orientation so that their respective electrical terminals are facing the first surface of the microphone carrier. The respective electrical terminals of the microphone carrier and integrated circuit die are aligned with, and electrically and mechanically connected to, the first and second carrier electrical contacts, respectively. Electrical terminals of the capacitive microphone transducer and integrated circuit die are electrically interconnected by electrical traces formed on the first surface of the microphone carrier.

This formation of electrical interconnections on the microphone carrier may also be utilised in traditional microphone packages where the capacitive microphone transducer and the integrated circuit die are positioned adjacent to each other with respective electrical terminals or pads facing upwardly. In this situation, the electrical terminals are connected by wire-bonding to the first and second carrier electrical contacts, respectively, placed on the underlying microphone carrier. In this embodiment of the invention, the microphone carrier may comprise a single layer or multi-layered printed circuit board or a ceramic substrate.

The first and second carrier electrical contacts may have a DC voltage difference larger than 0.5 Volt, or larger than 1.5 Volt or 1.8 Volt, in an operational state of the miniature microphone assembly. If one of the first and second carrier electrical contacts is used for supplying DC bias voltage to the capacitive microphone transducer, this electrical contact may have a DC voltage between 5 and 20 Volts relative to the other carrier electrical contact in an operational state of the miniature microphone assembly.

According to a preferred embodiment of the invention, one of the electrical contacts disposed on the surface of the microphone carrier comprises an electrically conductive sealing ring disposed in-between the capacitive microphone transducer and the microphone carrier. The sealing ring is used to acoustically seal a microphone back chamber formed in the microphone carrier and extending below a back plate member of the capacitive microphone transducer.

The microphone carrier may comprise various types of substrate material that are compatible with hydrophobic layer formation processes. The substrate material may be selected from the group of printed circuit board, ceramics, such as LTCC or HTCC, doped or undoped silicon, silicon nitride, and silicon oxide. Preferably, the surface of the microphone carrier is subjected to a plasma treatment so as to provide an intermediate oxided carrier surface or surfaces. Thereafter, the hydrophobic layer is deposited on top of the oxided surface. Alternatively, an adhesion layer, such as silicon-oxide, can be deposited after the plasma treatment as an intermediate process step before deposition of the hydrophobic layer.

The hydrophobic layer is preferably attached to the surface(s) of the microphone carrier and/or the die surface(s) of the integrated circuit by chemical bonding. The chemical bond ensures a temperature stable and mechanically robust adhesion between the surface(s) of the microphone carrier or integrated circuit die and the hydrophobic layer. The hydrophobic layer/coating may advantageously comprise a material, such as a chemically bonded material, selected from the group of alkylsilane, perfluoralkylsilane, perhaloalkylsilane and perfluorodecyltrichlorosilane (FDTS). Alternatively, the hydrophobic layer may comprise a physically bonded hydrophobic layer such as parylene or silicone.

The hydrophobic layer material and its deposition methodology are preferably selected to create a conformal coating of the relevant microphone carrier or integrated circuit die surface or surfaces so that each treated surface preferably has contact angle for water between 90° and 130°. In a preferred embodiment of the invention, the hydrophobic layer or coating comprises a self-assembled molecular monolayer.

The first and second transducer electrical contacts may be electrically coupled to the diaphragm and back-plate members, respectively. As previously mentioned, one of the electrical contacts may be formed as an annular electrically conductive sealing ring mating to a correspondingly shaped electrical terminal placed on the first surface of the microphone carrier.

In one embodiment, the capacitive microphone transducer comprises a diaphragm member and a back-plate member and first and second transducer electrical terminals electrically coupled to the diaphragm and back-plate members, respectively. In this situation, the back-plate member preferably comprises a perforated back-plate member adjacently positioned to the diaphragm member, and the diaphragm member comprises a through-going opening allowing molecules of the hydrophobic layer to travel through the opening and the perforated back-plate structure.

In another embodiment, the capacitive microphone transducer and integrated circuit die are attached to, and electrically connected to, the microphone carrier and electrically interconnected by electrical traces formed on or in the microphone carrier. In this situation, the capacitive microphone transducer is preferably located above the microphone carrier with the microphone electrical contact aligned with a first carrier electrical contact and, optionally, the integrated circuit die is positioned adjacent to capacitive microphone transducer and having the die electrical terminal aligned to a second carrier electrical contact.

In yet another embodiment, the microphone carrier comprises a second and substantially plane surface arranged oppositely to the first surface, the second surface comprising a plurality of microphone electrical contacts to allow surface mounting of the condenser microphone assembly to an external circuit board.

According to a preferred embodiment of the invention, the miniature microphone assembly is adapted for SMD compatible manufacturing techniques. The microphone carrier comprises a second and substantially planar surface arranged oppositely to the first surface and the second surface comprising a plurality of microphone electrical contacts to allow surface mounting attachment of the miniature microphone assembly to an external circuit board. The plurality of microphone electrical contacts are formed as solder pads or bumps and may comprise a DC voltage or power supply pad, a digital or analog output signal pad, a ground pad, clock signal input pad etc.

According to yet another embodiment of the invention, the miniature microphone assembly comprises an underfill agent deposited in a space between the microphone carrier and the capacitive microphone transducer. The underfill agent is preferably deposited so as to surround and encapsulate the microphone and carrier electrical terminals and, optionally, the die electrical terminal of the integrated circuit die. The presence of the underfill agent serves to further improve reliability of the microphone assembly to better withstand adverse conditions such as shocks, humidity, moisture, polluting agents or cyclic heat.

The underfill agent may comprise a first material with an organic polymer-based adhesive component such as an epoxy base resin and/or a cyanate ester resin. The underfill agent may advantageously comprise a second material comprising a filler material having a negative CTE (Coefficient of Thermal Expansion) such as Zirconium Tungstate. By selecting an appropriate blend of the first and second material, it is possible to match a CTE of the underfill blend to a wide range of target values as described in detail in co-pending patent application PCT/EP2007/011045, which is herein incorporated by reference in its entirety.

In a second aspect, the present invention relates to a portable communication device comprising a miniature microphone assembly according to any of the preceding embodiments. The portable communication device is selected from the group consisting of: mobile phones, head-sets, in-ear monitors, hearing prostheses or aids, game consoles, portable computers, and any combination thereof.

According to a third aspect of the present invention, there is provided a method of manufacturing a miniature microphone assembly. The manufacturing method comprising steps of: providing a microphone carrier comprising a carrier electrical terminal formed on a first surface of the microphone carrier and providing a capacitive microphone transducer comprising a transducer electrical terminal. The manufacturing method also includes providing an integrated circuit die comprising a die electrical terminal operatively coupled to signal amplification or signal conditioning circuitry of the integrated circuit die. The manufacturing method also includes attaching the capacitive microphone transducer and the integrated circuit die to the first surface of the microphone carrier and electrically interconnecting the transducer electrical terminal and the die electrical terminal through electrical traces formed in or on the microphone carrier. Subsequently, the miniature microphone assembly is placed in a vapour phase deposition chamber or liquid phase deposition container and a hydrophobic layer or coating is deposited onto the first surface of the microphone carrier.

During the process, the hydrophobic layer or coating may naturally be applied to additional exposed surfaces of the microphone carrier and/or the capacitive microphone transducer and/or the integrated circuit die. The extent to which these other exposed surfaces are coated depends on characteristics of the microphone assembly package and any shielding or cover members preplaced over certain surface portions of the microphone assembly as previously described.

According to a preferred embodiment of the present manufacturing methodology, the capacitive microphone transducer comprises a perforated back-plate member and an adjacently positioned diaphragm member. The diaphragm member comprises a through-going opening allowing molecules of the hydrophobic layer to travel through the opening and the perforated back-plate member. This embodiment is particularly advantageous because it allows a portion of the first surface of the microphone carrier positioned underneath the capacitive microphone transducer to be hydrophobically coated. This portion of the first surface of the microphone carrier may hold electrical traces or terminals that are on a DC voltage different from that of microphone carrier and therefore benefit from improved electrical insulation of the carrier surface portion.

According to a preferred embodiment of the manufacturing method, the hydrophobic layer is deposited by a bath process involving a plurality of MEMS microphone assemblies, such as 1000 to 5000 microphone assemblies. The plurality of MEMS microphone assembles, are assembled on a silicon wafer. The silicon wafer, or any other suitable carrier, is attached to a support tape. The silicon wafer is diced and the diced wafer, still holding the plurality of MEMS microphone assemblies, is moved into a deposition chamber The manufacturing method may advantageously comprise a step of depositing an underfill agent in a space between the microphone carrier and the capacitive microphone transducer and, optionally, a further step of depositing the underfill agent in a space between respective sidewalls of the capacitive microphone transducer and the integrated circuit die. The step of depositing the underfill agent is preferably carried out before deposition of the hydrophobic layer or coating. This process sequence has proved advantageous in improving the adhesion of the underfill agent to the exposed surfaces of the microphone assembly. This order of manufacturing steps furthermore allows the hydrophobic layer to cover any unintended perforations or voids in the underfill agent.

BRIEF DESCRIPTION OF THE DRAWINGS

The present invention will now be explained in greater details with reference to the accompanying figures, wherein.

Figure 1A:
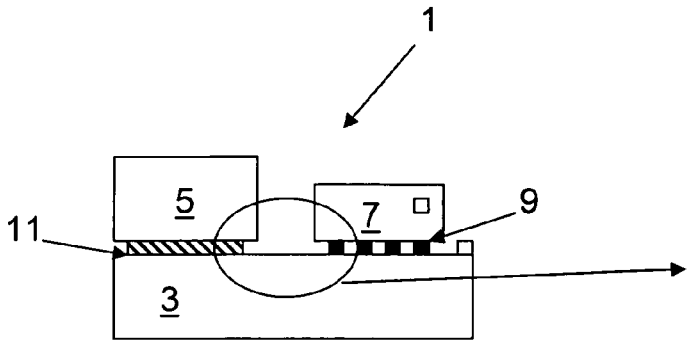
FIG. 1*a* is a simplified illustration of a prior art MEMS based miniature microphone assembly.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE DRAWINGS

FIGS. 1*a* and *b* illustrate a prior art MEMS or silicon-based microphone assembly 1 that comprises a MEMS capacitive transducer die 5 and an integrated circuit die 7, in the form of an Application Specific Integrated Circuit (ASIC), mounted adjacent to each other and both mechanically attached to an upper surface of a microphone carrier 3 by flip-chip bonding or mounting. The MEMS capacitive transducer die 5 and the integrated circuit die 7 are electrically coupled via respective sets of die electrical contacts 9 and transducer electrical contacts 11 to corresponding sets of aligned carrier electrical contacts. The microphone assembly 1 is accordingly formed as a so-called CSP device. The outer dimensions of the CSP packaged miniature microphone assembly may be about or less than 1.6 mm*2.4 mm*0.9 mm (W*L*H).

Figure 1B:
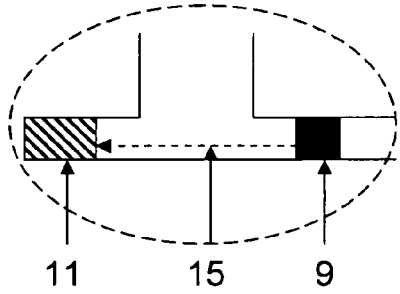
FIG. 1*b* is an enlarged and partial cross-sectional view of the indicated portion of the MEMS based miniature microphone assembly of FIG. 1*a*.

An inherent consequence of these small dimensions is closely spaced electrical pads or terminals on the microphone carrier 3 which makes the microphone assembly 1 vulnerable to parasitic current leakage paths, such as, for example, a leakage path 15 created between a ground electrical terminal 11 and a high impedance signal input (or output) terminal 9 as illustrated by FIG. 1*b*. The current leakage path may be created by formation or absorption of a thin electrically conducting layer of moisture, water or any other contamination agent deposited on the surface of the microphone carrier in-between the illustrated ground terminal 11 and input signal terminal 9. Depending on the electrical characteristics of relevant circuitry of the integrated circuit die 7 and resistive properties of the current leakage path 15, the MEMS based microphone assembly 1 may either cease to operate according to its electrical specifications, or even worse completely cease operation.

Figure 2:
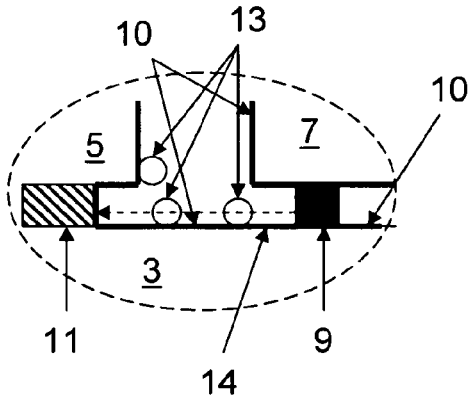
FIG. 2 illustrates the MEMS based miniature microphone assembly according to a first embodiment of the invention wherein a hydrophobic surface coating has been deposited on exposed surfaces.

The MEMS based microphone assembly 1 illustrated in FIG. 2, according to a preferred embodiment of the present invention, corresponds largely to the MEMS based microphone assembly 1 of FIGS. 1*a* and 1*b*, and corresponding features have been given identical reference numerals, expect for the inclusion of the illustrated hydrophobic layer 10. The hydrophobic layer 10 (not to scale) is deposited on the respective surfaces and sidewalls of the microphone carrier 3, the integrated circuit die 7 and even on the MEMS based capacitive transducer die 5. The hydrophobic layer 10 preferably comprises a self-assembled molecular monolayer (SAM) based on an alkylsilane that form a conformal highly hydrophobic layer that at least cover the entire upper surface of the microphone carrier 14 (except for the electrical pads). The hydrophobic property of the microphone carrier surface has been illustrated in FIG. 2 by the sharply defined and nearly spherical shape or contour of water droplets 13 formed on the coated carrier surface 14. The spherical shape is opposite to water/moisture droplets on hydrophilic surfaces that tend to spread out and create a thin continuous (electrically conductive) film that creates an undesired current leakage path in-between otherwise isolated electrical terminals or pads.

Figure 3A:
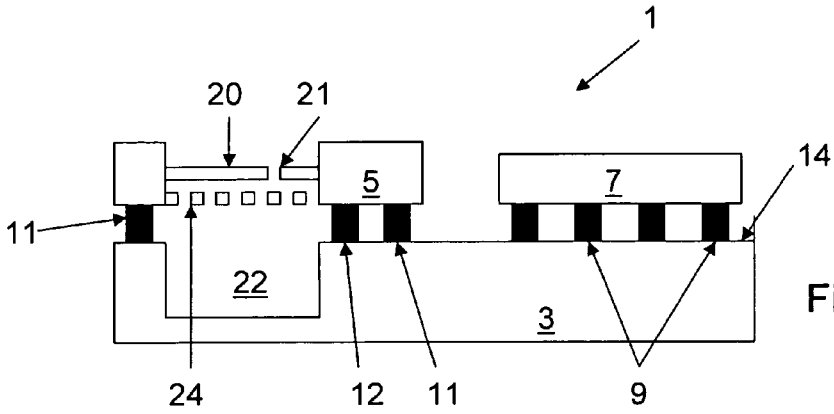
FIGS. 3*a*-3*d* illustrate three different manufacturing states of a MEMS based miniature microphone assembly according to a second embodiment of the invention.
Figure 3B:
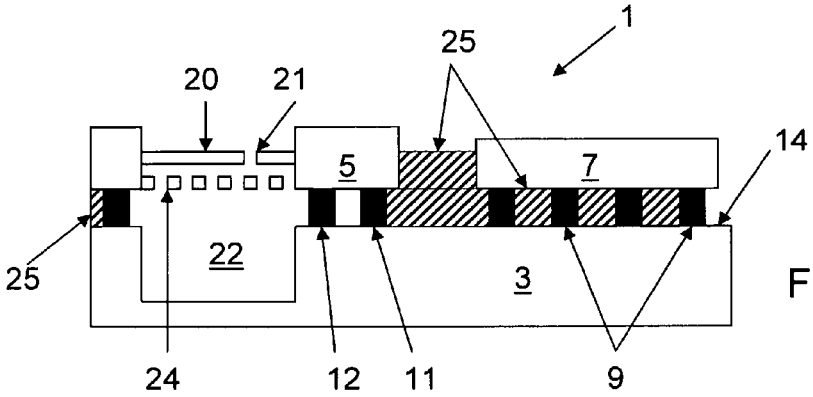
Figure 3C:
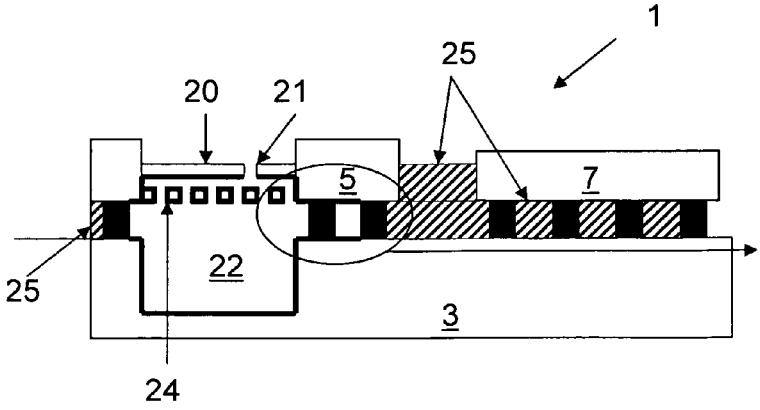

FIG. 3*a*-3*c* illustrate three individual manufacturing states of a MEMS based miniature microphone assembly 1 or MEMS microphone 1 according to a second embodiment of the invention. The manufacturing process is preferably implemented as batch process wherein a plurality of MEMS based miniature microphone assembles, such as 1000 to 5000 assemblies, are provided on a silicon wafer attached to a support tape. The manufacturing process begins with the provision of a microphone carrier 3, a MEMS based capacitive microphone transducer or MEMS transducer 5, and an integrated circuit die 7.

The MEMS transducer 5 comprises a displaceable diaphragm member 20 and an adjacently positioned back-plate member 24 separated by a narrow air gap with a height of about 5 μm. The back-plate member 24 is a highly perforated member or structure with a plurality of acoustic holes. The diaphragm member 20 includes a through-going DC vent 21 or static pressure relief opening. A back chamber 22 for the MEMS transducer 5 is carved out in the microphone carrier 3 and arranged below the diaphragm/back-plate assembly and in alignment therewith.

The MEMS transducer 5 and the integrated circuit die 7 are provided with respective sets of flip-chip compatible electrical pads or terminals. The MEMS transducer 5 and the integrated circuit die 7 are subsequently bonded, preferably by soldering or welding, to corresponding flip-chip compatible electrical pads or terminals arranged on the upper surface 14 of the microphone carrier 3 according to normal flip-chip assembly techniques. In this state of the manufacturing process, each of the MEMS microphones of the batch is packaged in CSP format as illustrated by FIG. 3*a*. One of the electrical terminals of the MEMS transducer 5 is formed as an electrically conductive solder sealing ring 11 disposed in-between the MEMS transducer 5 and the upper surface 14 of microphone carrier 3. The sealing ring 11 surrounds the microphone back chamber 22 and operates to both acoustically seal the microphone back chamber and to establish electrical/mechanical interconnection between the MEMS transducer 5 and the microphone carrier 3.

Thereafter, an underfill agent 25 comprising an epoxy base resin is deposited in a space between the upper surface 14 of microphone carrier 3 and lower surface of the MEMS transducer 5, in-between opposing side wall portions of the latter components, and into a space between the upper surface 14 of microphone carrier 3 and a lower surface of the integrated circuit die 7. The deposition of the underfill agent 25 is preferably made by jet dispensing apparatus capable of dispensing very small droplets of the underfill agent in a well-controlled manner. After completion of the underfill deposition, the MEMS microphone 1 has reached the state illustrated by FIG. 3*b*.

Figure 3D:
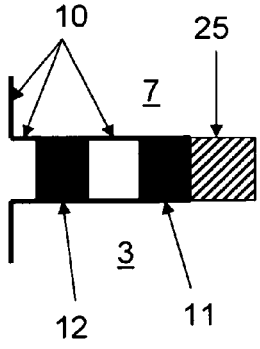

Subsequently, the batch of MEMS microphones is placed in a gas or vapour phase deposition chamber and a hydrophobic layer is deposited onto the upper surface 14 of the microphone carrier 3 including exposed wall portions of the back chamber 22. Experimental work showed satisfactory coating results when the batch of MEMS microphones was placed in a gas deposition chamber with a substantially saturated gas containing hydrophobic layer material for a period of several hours such as between 2 and 24 hours. This deposition time allows the hydrophobic layer material to form a SAM coating covering all directly exposed surface portions of the entire MEMS microphone 1 as well as microphone carrier surfaces positioned underneath the MEMS transducer 5, as illustrated in FIG. 3*d*, which is an enlarged partial view of FIG. 3*c*. These latter carrier surfaces may hold electrical traces or terminals, such as the illustrated second transducer electrical terminal 12, which is/are on a DC voltage different from that of the bulk of the microphone carrier 3 or different from an adjacent electrical terminal and therefore benefit by the improvement of the electrical insulation of the carrier surface.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A miniature microphone assembly comprising:

a capacitive microphone transducer comprising a transducer electrical terminal;

a microphone carrier comprising a carrier electrical terminal formed on a first surface thereof;

an integrated circuit die comprising a die electrical terminal operatively coupled to signal amplification or signal conditioning circuitry of the integrated circuit die; and wherein the first surface of the microphone carrier comprises a hydrophobic layer or coating and wherein the hydrophobic layer or coating is solely comprised of a self-assembled molecular monolayer in direct exposure to moisture to protect the first surface of the microphone carrier.

2. A miniature microphone assembly according to claim 1, wherein the integrated circuit die comprises a die surface with a hydrophobic coating.

3. A miniature microphone assembly according to claim 1, wherein the capacitive microphone transducer comprises a condenser element or electret element.

4. A miniature microphone assembly according to claim 1, wherein the microphone carrier comprises first and second carrier electrical contacts separated by a distance of less than 1000 μm.

5. A miniature microphone assembly according to claim 4, wherein the first and second carrier electrical contacts have a DC voltage difference larger than 0.5 Volt, in an operational state of the miniature microphone assembly.

6. A miniature microphone assembly according to claim 4, wherein the first and second carrier electrical contacts comprise:

a first terminal electrically connected to the die electrical terminal of the integrated circuit die; and a second terminal electrically connected to a ground line or DC voltage supply line.

7. A miniature microphone assembly according to claim 6, wherein the second terminal comprises an electrically conductive sealing ring disposed in-between the capacitive microphone transducer and the microphone carrier.

8. A miniature microphone assembly according to claim 1, wherein a capacitance of the capacitive microphone transducer is less than 20 pF.

9. A miniature microphone assembly according to claim 1, wherein the hydrophobic coating is chemically bound to at least one of the surface of the microphone carrier or the die surface of the integrated circuit.

10. A miniature microphone assembly according to claim 1, wherein the hydrophobic coating has a contact angle for water between 90° and 130°.

11. A miniature microphone assembly according to claim 1, wherein the capacitive microphone transducer comprises a diaphragm member and a back-plate member and first and second transducer electrical terminals electrically coupled to the diaphragm and back-plate members, respectively.

12. A miniature microphone assembly according to claim 11, wherein the back-plate member comprises a perforated back-plate member adjacently positioned to the diaphragm member, and the diaphragm member comprises a through-going opening allowing molecules of the hydrophobic layer to travel through the opening and the perforated back-plate structure.

13. A miniature microphone assembly according to claim 1, wherein the capacitive microphone transducer and integrated circuit die are attached to, and electrically connected to, the microphone carrier and electrically interconnected by electrical traces formed on or in the microphone carrier.

14. A miniature microphone assembly according to claim 13, wherein the capacitive microphone transducer is located above the microphone carrier with a microphone electrical contact aligned with a first carrier electrical contact.

15. A miniature microphone assembly according to claim 1, wherein the microphone carrier comprises:

a second and substantially planar surface arranged oppositely to the first surface, the second surface comprising a plurality of microphone electrical contacts to allow surface mounting of the condenser microphone assembly to an external circuit board.

16. A miniature microphone assembly according to claim 1, further comprising an underfill agent deposited in a space between the microphone carrier and the capacitive microphone transducer.

17. A portable communication device comprising a miniature microphone assembly according to claim 1, said portable communication device being selected from the group consisting of mobile phones, head-sets, in-ear monitors, hearing prostheses or hearing aids, game consoles, portable computers, and any combination thereof.

18. A method of manufacturing a miniature microphone assembly, the method comprising:

providing a microphone carrier comprising a carrier electrical terminal formed on a first surface of the microphone carrier;

providing a capacitive microphone transducer comprising a transducer electrical terminal;

providing an integrated circuit die comprising a die electrical terminal operatively coupled to signal amplification or signal conditioning circuitry of the integrated circuit die;

attaching the capacitive microphone transducer and the integrated circuit die to the first surface of the microphone carrier;

electrically interconnecting the transducer electrical terminal and the die electrical terminal through electrical traces formed on or in the microphone carrier;

placing the miniature microphone assembly in a vapour phase deposition chamber or liquid phase deposition container; and depositing a hydrophobic layer or coating onto the first surface of the microphone carrier, wherein the deposited hydrophobic layer or coating is solely comprised of a self-assembled molecular monolayer exposed directly to moisture to protect the first surface of the microphone carrier.

19. A method of manufacturing a miniature microphone assembly according to claim 18, further comprising:

depositing an underfill agent in a space between the microphone carrier and the capacitive microphone transducer.

20. A method of manufacturing a miniature microphone assembly according to claim 19, further comprising:

depositing the underfill agent in a space between respective sidewalls of the capacitive microphone transducer and the integrated circuit die.

21. A method of manufacturing a miniature microphone assembly according to claim 18, wherein:

the capacitive microphone transducer comprises a perforated back-plate member and an adjacently positioned diaphragm member; and the diaphragm member comprises a through-going opening allowing molecules of the hydrophobic layer to travel through the opening and the perforated back-plate member.

22. The miniature microphone assembly according to claim 11, wherein the hydrophobic self-assembled molecular monolayer extends to cover at least a portion of the surface of the carrier which is positioned underneath the capacitive microphone transducer, and to cover at least a portion of a surface of the microphone transducer that faces the portion of the surface of the carrier positioned underneath the transducer.

23. The miniature microphone assembly according to claim 1, wherein the hydrophobic self-assembled molecular monolayer is disposed on a region of the surface of the carrier between the die electrical terminal and the transducer electrical terminal to inhibit formation of an electrically conductive moisture film thereby preventing a parasitic leakage current from flowing between the transducer electrical terminal and the die electrical terminal via the moisture film.

* * * * *